United States Patent [19]

Budzich

[11] 4,362,088

[45] Dec. 7, 1982

[54] LOAD RESPONSIVE FLUID CONTROL VALVE

[76] Inventor: Tadeusz Budzich, 80 Murwood Dr., Moreland Hills, Ohio 44022

[21] Appl. No.: 109,806

[22] Filed: Jan. 7, 1980

Related U.S. Application Data

[63] Continuation-in-part of Ser. No. 109,053, Jan. 2, 1980.

[51] Int. Cl.[3] ..... F15B 13/04

[52] U.S. Cl. ..... 91/446; 91/448; 137/596; 137/596.13

[58] Field of Search ..... 91/446, 448; 137/596, 137/596.13

[56] References Cited

U.S. PATENT DOCUMENTS

Re. 29,538 2/1978 Budzich ..... 137/596.2

4,282,898 8/1981 Harmon et al. ..... 137/596.13

*Primary Examiner*—Gerald A. Michalsky

[57] ABSTRACT

A direction flow control valve for control of positive loads equipped with a load responsive positive load control, which automatically regulates valve inlet pressure to maintain a relatively constant pressure differential between inlet pressure and load pressure and which permits variation in the level of pressure differential in response to an external control signal, while this pressure differential is maintained constant at each controlled level.

35 Claims, 10 Drawing Figures

$P_1 - P_W = \Delta P_y$ $P_1 - P_2 = \Delta P$ $P_W - P_2 = \Delta P_x$ $\therefore \Delta P_y = \Delta P - \Delta P_x$

LOAD RESPONSIVE FLUID CONTROL VALVE

This is a continuation in part of application Ser. No. 109,053, filed Jan. 2, 1980, for "Load Responsive System Controls."

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system in which a plurality of loads is individually controlled under positive load conditions by separate control valves.

In more particular aspects this invention relates to direction and flow control valves capable, in a proportional way, of controlling simultaneously a number of loads under positive load conditions.

In still more particular aspects this invention relates to load responsive controls of direction control valves, which permit variation in the level of control differential between pump discharge pressure and the load pressure signal, while this control differential is automatically maintained constant at each controlled level.

In still more particular aspects this invention relates to load responsive controls of direction control valves, which permit variation in the controlled pressure differential between valve outlet pressure and the load pressure, in response to an external control signal.

Closed center load responsive fluid control valves are very desirable for a number of reasons. They permit load control with reduced power loss and therefore, increase system efficiency and when controlling one load at a time provide the proportional feature of flow control, irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant, irrespective of the variation in magnitude of the load. The application of such a system is however, limited by one basic system disadvantage.

Normally in such a system the load responsive valve control can maintain a constant presure differential and therefore constant flow characteristics when operating only one load at a time. With two or more loads, simultaneously controlled, only the highest of the loads will retain the flow control characteristics, the speed of actuation of lower loads varying with the change in magnitude of the highest load. Fluid control valve for such a system is shown in U.S. Pat. No. 3,488,953 issued to Haussler.

This drawback can be overcome in part by the provision of a proportional valve, as disclosed in my U.S. Pat. No. 3,470,694, dated Oct. 7, 1969 and also in U.S. Pat. No. 3,455,210 issued to Allen on July 15, 1969. However, while those valves are effective in proportionally controlling multiple positive loads at a time, they provide a constant pressure differential and therefore a constant throttling loss across each valve, thus reducing system efficiency.

SUMMARY OF THE INVENTION

It is therefore a principal object of this invention to provide improved load responsive direction control valve, which permits variation in the level of control differential between valve outlet pressure and load pressure, while this control differential is automatically maintained constant at each controlled level.

Another object of this invention is to provide load responsive controls of a direction control valve, through which control of system load can be either accomplished by variation in area of the orifice, between the valve control and a fluid motor, while the pressure differential across this orifice is maintained constant at a specific level, or by control of pressure differential, acting across this orifice, while the area of the orifice remains constant.

It is a further object of this invention to provide load responsive controls of a direction control valve, which permit variation in the controlled pressure differential across a metering orifice in response to an external control signal.

It is a further object of this invention to provide load responsive controls of a direction control valve, in which an external control signal, at a minimum force level, can adjust and control the pressure differential, acting across a metering orifice of a load responsive direction control valve, while the system load is being controlled by variation in area of the metering orifice.

It is a further object of this invention to provide load responsive controls of direction control valve, which modify control signals, supplied to the valve controls, to control the pressure differential across an orifice of a load responsive direction control valve.

Briefly the foregoing and other additional objects and advantages of this invention are accomplished by providing novel load responsive control of a direction control valve, to throttle fluid supplied from the pump either in response to one control input, namely variation in the area of metering orifice, to control a constant pressure differential, at a preselected level between valve outlet pressure and the load pressure, or in response to another control input, namely modification in the pressure of control signal, to vary the level of the control differential between valve outlet pressure and the load pressure, while this control differential is automatically maintained constant at each controlled level by valve control. In this way a load can be controlled in response to either input providing identical control performance, or the variable pressure differential control can be superimposed on the control action controlling a load by variation in the area of the metering orifice. Therefore this control system lends itself very well to an application, in which a manual control input from an operator may be modified by an electronic logic circuit, or a micro-processor.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
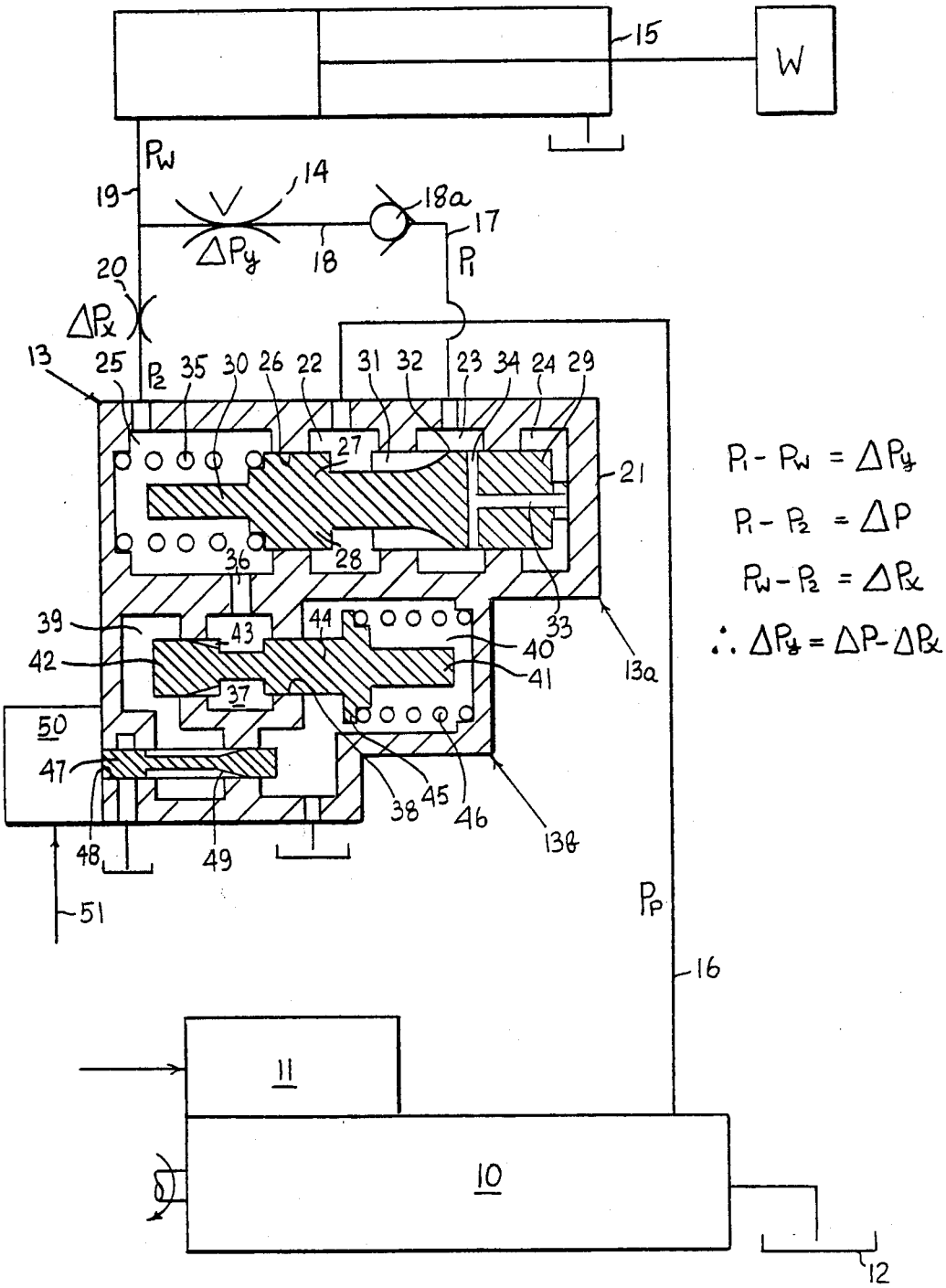
FIG. 1 is a diagrammatic representation of a load responsive throttling control for adjustment in the level of control differential from a certain preselected level to zero level, with fluid motor and system pump shown schematically.

Referring now to FIG. 1, the hydraulic system shown therein comprises a fluid pump 10, equipped with an output flow control 11, connected to a reservoir 12. The output flow control 11 regulates delivery of the pump 10 into a load responsive circuit, composed of a differential throttling control, generally designated at 13, regulating the level of the pressure differential developed across schematically shown variable orifice 14, interposed between the differential throttling control 13 and a fluid motor 15, operating load W. The pump 10 may be of a fixed or variable displacement type and may respond to an external or internal control signal. With the pump 10 being of a fixed displacement type, responding to an external control signal, the output flow control 11, in a well known manner, regulates delivery from pump to the load responsive circuit, by bypassing part of the pump flow to the system reservoir 12. The pump 10 of fixed displacement type can also respond to maximum pressure limiting signal, with the use of conventional relief valve, well known in the art. With the pump 10 being variable displacement type and capable of responding to an external control signal, the output flow control 11, in a well known manner, regulates through a displacement changing mechanism delivery from the pump to load responsive circuit, by changing pump displacement. The pump 10 of variable displacement type can also respond to the maximum pressure limiting signal, such a control, well known in the art, being in the form of a conventional pressure compensator.

Discharge line 16 of pump 10 is connected through the differential throttling control, generally designated as 13, line 17, variable metering orifice 14 and lines 18 and 19 to the fluid motor 15. The fluid motor 15 is also connected by line 19 and orifice 20 with the differential throttling control 13.

The differential throttling control, generally designated as 13, composed of a throttling section, generally designated as 13*a* and a signal modifying section, generally designated as 13*b*, comprises a housing 21 having inlet chamber 22, an outlet chamber 23, a first control chamber 24 and a second control chamber 25, all of those chambers being connected by bore 26, slidably guiding a throttling spool 27. The throttling spool 27, equipped with lands 28 and 29 and stop 30, is provided with throttling slots 31, terminating in the cut-off edges 32, between the inlet chamber 22 and the outlet chamber 23. One end of the throttling spool 27 projects into the first control chamber 24, which communicates through passages 33 and 34 in the throttling spool 27 with the outlet chamber 23. The other end of the throttling spool 27 projects into the second control chamber 25 and is biased by a control spring 35. The second control chamber 25 is connected through line 19 and orifice 20 to the fluid motor 15 and is also connected through port 36 with the supply chamber 37, connected by bore 38 with a third control chamber 39 and an exhaust chamber 40. Bore 38 slidably guides a control spool 41, equipped with land 42, provided with throttling slots 43 and positioned between the supply chamber 37 and the third control chamber 39, a land 44 separating the supply chamber 37 and the exhaust chamber 40 and a flange 45. A spring 46 is interposed in the exhaust chamber 40 between the flange 45 of the control spool 41 and the housing 21. The exhaust chamber 40 and the third control chamber 39 are selectively interconnected by metering orifice created by a stem 47 guided in bore 48 and provided with metering slots 49. The stem 47 is connected to an actuator 50 responsive to external control signal 51.

Figure 2:
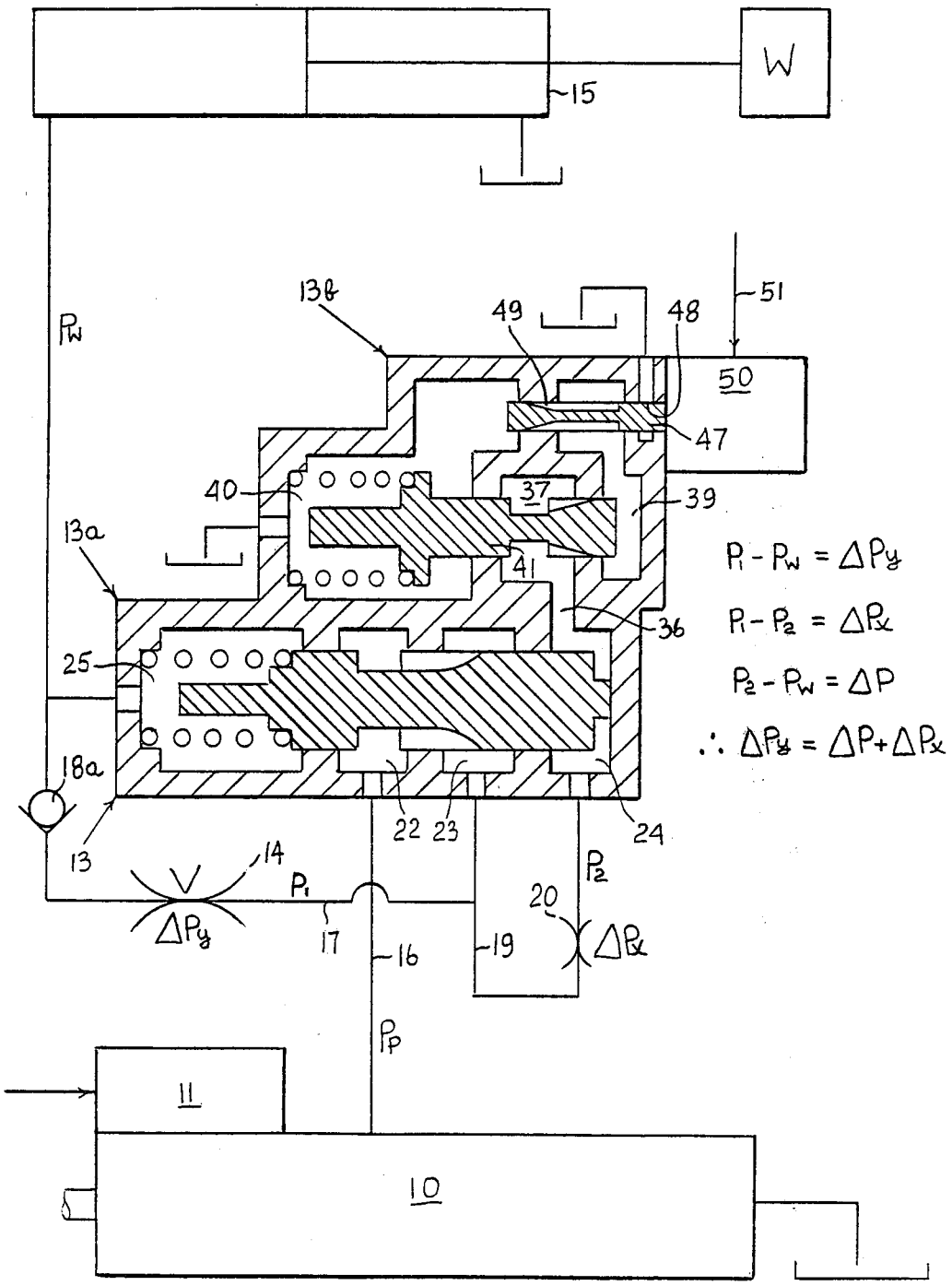
FIG. 2 is a diagrammatic representation of a load responsive throttling control for adjustment in the level of control differential from a certain minimum preselected value up to maximum level, with fluid motor and system pump shown schematically.

Referring now to FIG. 2, the same components used in FIG. 1 are designated by the same numerals. The only difference between the load responsive controls of FIGS. 1 and 2 is the phasing of the internal components of the differential control 13 and connections of individual ports or chambers with the fluid motor 15 and the pump 10. In both figures, in an identical way, the pump pressure is transmitted through discharge line 16, the inlet chamber 22, the outlet chamber 23, line 17 and variable orifice 14 to the fluid motor 15. Line 17 however, is connected in FIG. 2 through line 19 and orifice 20 to the first control chamber 24. The second control chamber 25 is in direct communication through line 17 with load pressure Pw of the fluid motor 15. The supply chamber 37 is connected through port 36 with the first control chamber 24 and selectively interconnected with the third control chamber 39 by the control spool 41.

Figure 3:
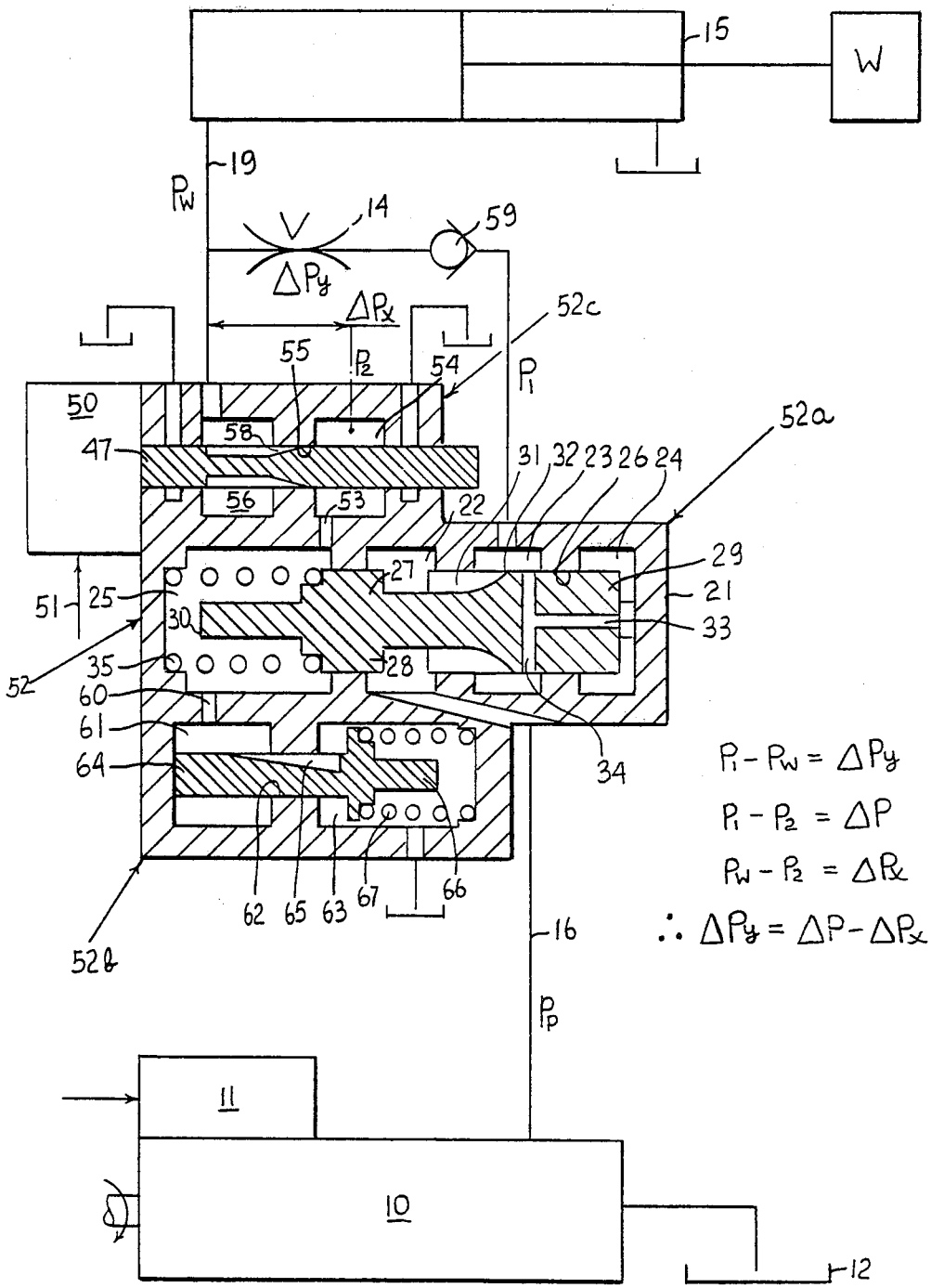
FIG. 3 is a diagrammatic representation of another embodiment of the load responsive control of FIG. 1, with fluid motor and system pump shown schematically.

Referring now to FIG. 3, the same components used in FIGS. 1 and 2 are designated by the same numerals. The basic load responsive circuit of FIG. 3, with some of the circuit components including some of the internal components of differential throttling control, generally designated as 52, are the same as those of FIGS. 1 and 2. The differential throttling control 52 is composed of a throttling section 52*a*, identical to throttling section 13*a* of FIGS. 1 and 2, a flow control valve section 52*b* and a metering valve section 52*c*. The second control chamber 25 is connected by port 53 with a first pressure chamber 54, which in turn is connected through bore 55 with a second pressure chamber 56, which guides a stem 47, equipped with metering slots 58. The stem 47 is connected to the actuator 50, responsive to the external control signal 51. A load check 59 is interposed between the fluid motor 15 and the outlet chamber 23. The second control chamber 25 is also connected through port 60 with a third pressure chamber 61, connected by bore 62 with a second exhaust chamber 63. Bore 62 axially guides a metering pin 64, provided with metering slot 65. The metering pin 64 is provided with a stop 66 and biased, towards position as shown, by a spring 67, contained in the second exhaust chamber 63.

Figure 4:
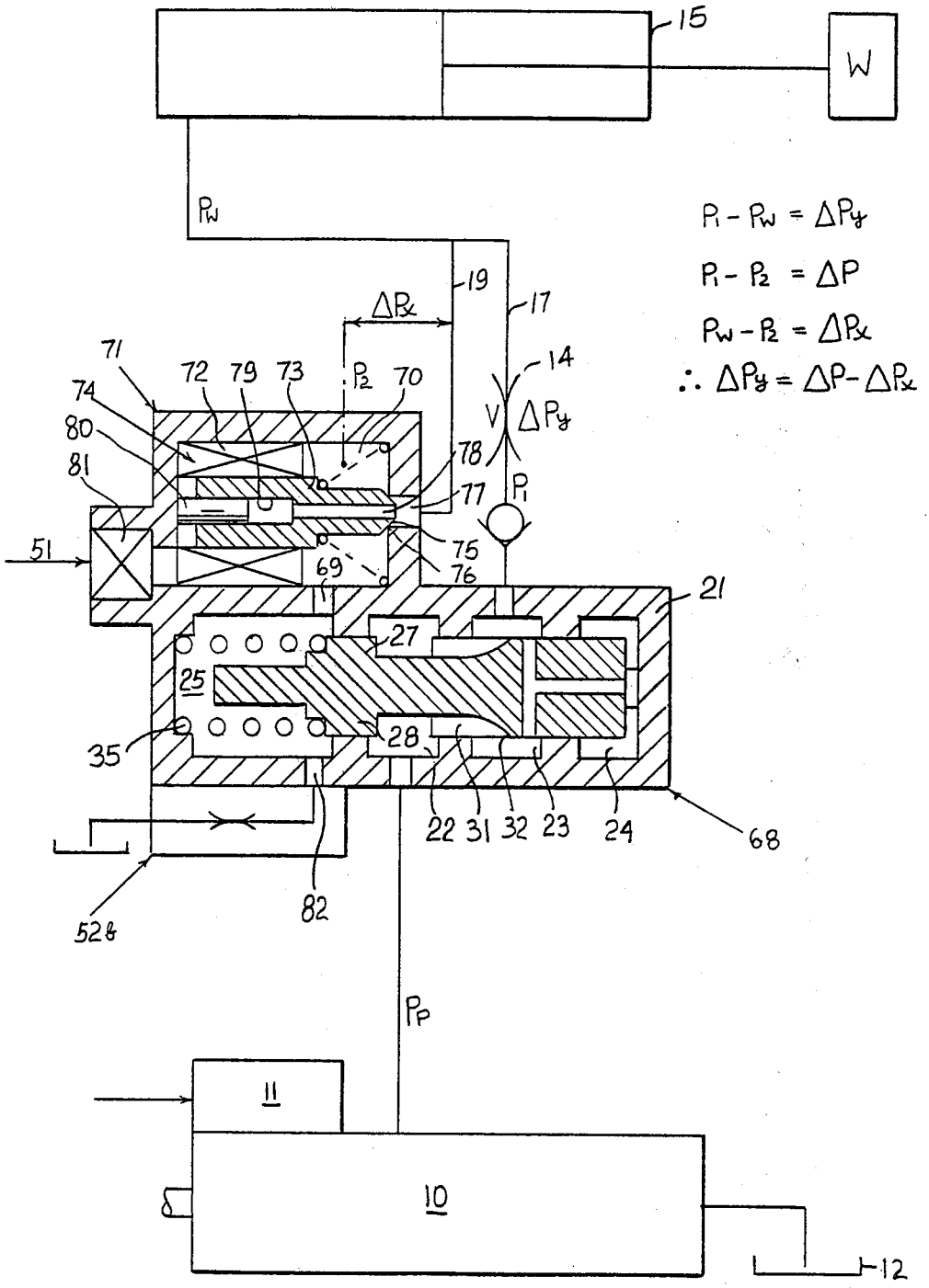
FIG. 4 is a diagrammatic representation of still another embodiment of the load responsive control of FIG. 1, with fluid motor and system pump shown schematically.

Referring now to FIG.4, the same components used in FIGS. 1, 2 and 3 are designated by the same numerals. The basic load responsive circuit of FIG. 4 with some of the circuit components, including some of the internal components of differential throttling control, generally designated as 68, are the same as those in FIGS. 1, 2 and 3. The second exhaust chamber 25 is connected by port 69 to the chamber 70 of the differential valve, generally designated as 71. The differential valve 71 comprises a coil 72, retained in the housing, which guides an armature 73 of a solenoid, generally designated as 74. The armature 73 is provided with conical surface 75, selectively engagable with sealing edge 76 of inlet port 77 and venting passage 78 terminating in bore 79, guiding a reaction pin 80. The coil 72 is connected by sealed connector 81 to outside of the housing 21, external control signal being applied to the sealed connector 81. The second control chamber 25 is connected through port 82 with schematically shown flow control valve section, generally designated as **52*b*, which may be identical to flow control valve 52*b* of FIG. 3**.

Figure 5:
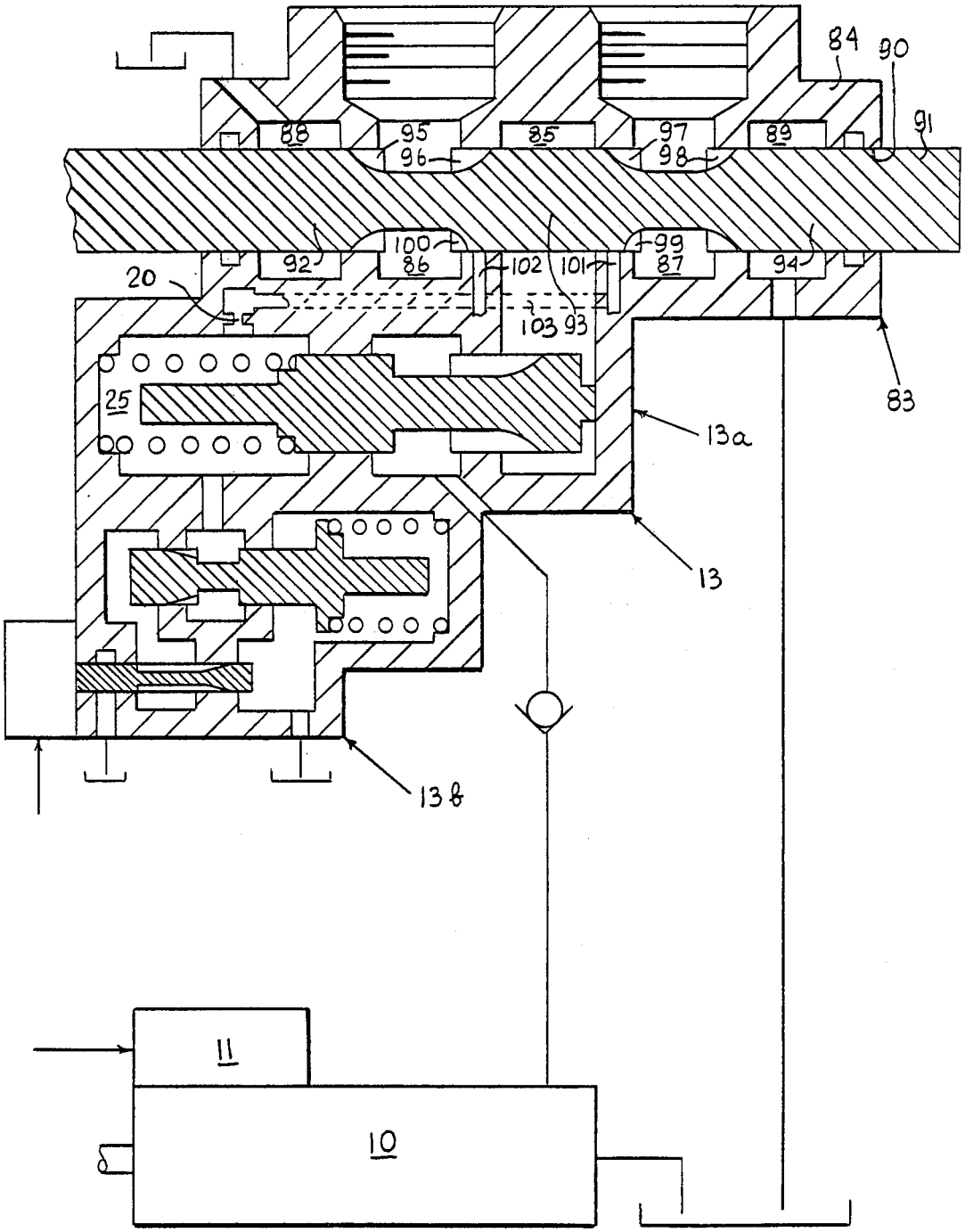
FIG. 5 is a sectional view through a four way load responsive direction control valve using the control of FIG. 1 with system pump and reservoir shown schematically.

Referring now to FIG. 5 the same components used in FIGS. 1, 2, 3 and 4 are designated by the same numerals. The differential throttling control 13 of FIG. 1 was integrated in FIG. 5 into a four way valve assembly, generally designated as 83, which is basically equivalent to variable metering orifice 14 of FIG. 1. The four way valve assembly, generally designated as 83, comprises a housing 84 having a supply chamber 85, load chambers 86 and 87 and exhaust chambers 88 and 89, interconnected by bore 90, guiding a valve spool 91. The valve spool 91 is provided with lands 92, 93 and 94, throttling slots 95, 96, 97 and 98 and signal slots 99 and 100. The housing 84 is also provided with load sensing ports 101 and 102, communicating through passage 103 and orifice 20 to the second control chamber 25, of the differential throttling control 13.

Figure 6:
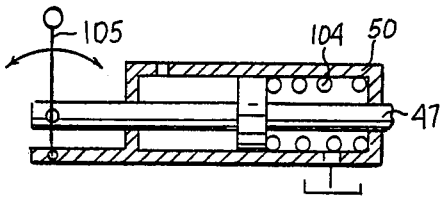
FIG. 6 is a diagrammatic representation of manual control input into the load responsive controls of FIGS. 1 to 5.

Referring now to FIG. 6 the stem 47 of the actuator 50 of FIGS. 1 to 5 is biased by a spring 104 towards position of zero orifice and is directly operated by a lever 105, which provides the external signal 51.

Figure 7:
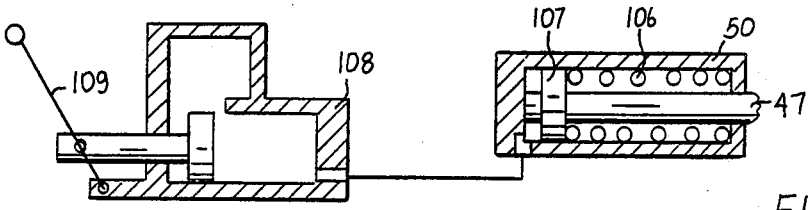
FIG. 7 is a diagrammatic representation of hydraulic control input into load responsive controls of FIGS. 1 to 5.

Referring now to FIG. 7, the stem 47 of the actuator 50 of FIGS. 1 to 5, is biased by a spring 106 towards position of zero orifice and is directly operated by a piston 107. Fluid pressure is supplied to the piston 107 from a pressure generator 108, operated by a lever 109.

Figure 8:
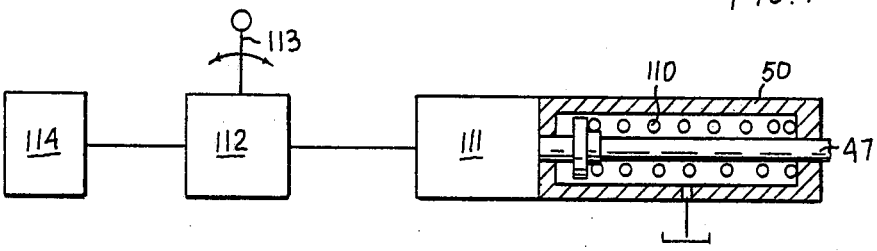
FIG. 8 is diagrammatic representation of electrohydraulic control input into load responsive controls of FIGS. 1 to 5.

Referring now to FIG. 8, the stem 47 of the actuator 50 of FIGS. 1 to 5, is biased by a spring 110 towards position of zero orifice and is directly operated by a solenoid 111, connected by line to an input current control 112, operated by a lever 113 and supplied from an electrical supply source 114.

Figure 9:
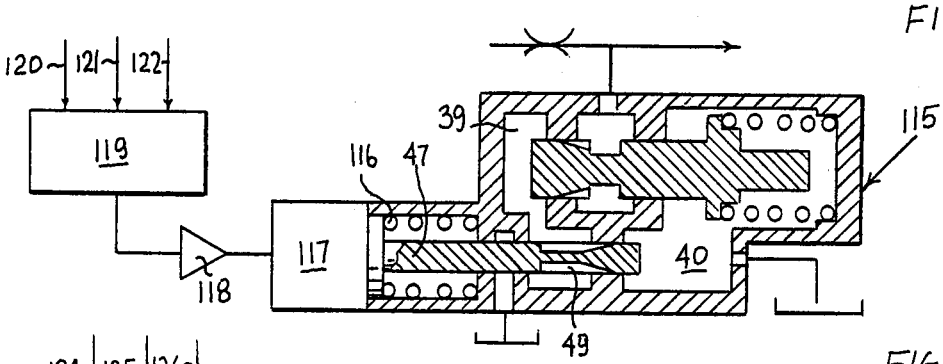
FIG. 9 is a diagrammatic representation of an electromechanical control input into load responsive controls of FIGS. 1 to 5.

Referring now to FIG. 9, the stem 47 of the differential control, generally designated as 115, is biased by a spring 116 towards a position, where it isolates the third control chamber 39 from the exhaust chamber 40 and is controlled by a solenoid 117. The electrical control signal, amplified by amplifier 118, is transmitted from a logic circuit or a micro-processor 119, subjected to inputs 120, 121 and 122.

Figure 10:
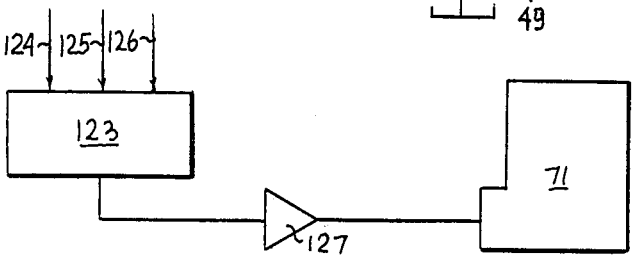
FIG. 10 is a diagrammatic representation of an electro mechanical control input into load responsive system of FIG. 4.

Referring now to FIG. 10 a logic circuit or a micro-processor 123, supplied with control signals 124, 125 and 126, transmits an external control signal to the differential valve 71 through an amplifier 127.

Referring now to FIG. 1, the differential throttling control 13 is interposed between the pump 10 and the fluid motor 15 and controls the fluid flow and pressure therebetween. The differential throttling control 13 is composed of the throttling section **13*a* and the signal modifying section 13*b*. The throttling section 13*a* with its throttling spool 27 throttles with throttling slots 31 fluid flow from the inlet chamber 22, connected by discharge line 16 to the pump 10, to the outlet chamber 23, connected by line 17 and variable orifice 14 with the fluid motor 15, to automatically maintain a constant pressure differential across variable orifice 14. This control action is accomplished in the following way. Fluid from the outlet chamber 23 at $P_1$ pressure, which is the pressure acting upstream of variable orifice 14 is transmitted through passage 34 and 33 to the first control chamber 24 where, reacting on the cross-sectional area of the throttling spool 27, generates a force tending to move the throttling spool 27 from right to left, in the direction of closing of the flow area through the throttling slots 31 and therefore in direction of increasing the throttling action of the throttling spool 27. Fluid at the load pressure Pw, which is the pressure acting down stream of variable orifice 14, is transmitted through line 19 and orifice 20 to the second control chamber 25 where, reacting on the cross-sectional area of the throttling spool 27, it generates a force tending to move the throttling spool 27 from left to right, in the direction of increasing the flow area through the throttling slots 31 and therefore in direction of decreasing the throttling action of the throttling spool 27. This force due to pressure in the second control chamber 25 is supplemented by the biasing force of the control spring 35. Assume that the stem 47 is in the position, as shown in FIG. 1, isolating the third control chamber 39 from the exhaust chamber 40 and therefore making the signal modifying section 13*b* inactive. The throttling spool 27, subjected to $P_1$ and $P_2$ pressures and the biasing force of control spring 35, will reach a modulating position, in which by throttling action of throttling slots 31 will throttle the pump pressure Pp to a level of $P_1$ pressure, which is higher, by a constant pressure differential $\Delta P$, than $P_2$ pressure and equal to the quotient of the biasing force of control spring 35 and the cross-sectional area of the throttling spool 27. If $P_2$ pressure is equal to Pw pressure, which is the case when the stem 47 is in the position, as shown in FIG. 1, the throttling section 13*a*, by throttling fluid flow from the inlet chamber 22 to the outlet chamber 23, will automatically maintain a constant pressure differential $\Delta P$ between the first control chamber 24 and the second control chamber 25 and with $\Delta Py$ becoming $\Delta P$, will also maintain a constant pressure differential across variable orifice 14. With constant pressure differential, acting across an orifice, the flow through an orifice will be proportional to the area of the orifice and independent of pressure in the fluid motor. Therefore by varying the area of variable orifice 14, the fluid flow to the fluid motor 15 and velocity of the load W can be controlled, each specific area of variable orifice 14** corresponding to a specific velocity of load W, which will remain constant, irrespective of the variation in the magnitude of the load W.

In the arrangement of FIG. 1 the relationhip between load pressure Pw and signal pressure $P_2$ is controlled by the signal modifying section, generally designated as 13*b*, and orifice 20. Assume that the stem 47, positioned by the actuator 50 in response to external control signal 51, as shown in FIG. 1, blocks completely metering orifice through metering slots 49, isolating the third control chamber 39 from the exhaust chamber 40. The control spool 41 with its land 42, protruding into the third control chamber 39, will generate pressure in the third control chamber 39, equivalent to the preload of the spring 46. Displacement of the stem 47 to the right will move metering slots 49 out of bore 48, creating an orifice area, through which fluid flow will take place from the third control chamber 39 to the exhaust chamber 40. The control spool 41, biased by the spring 46, will move from right to left, connecting by throttling slots 43 the supply chamber 37 with the third control chamber 39. Rising pressure in the third control chamber 39, reacting on cross-sectional area of control spool 41, will move it back into a modulating position, in which sufficient flow of pressure fluid will be throttled from the supply chamber 37 to the third control chamber 39, to maintain the third control chamber 39 at a constant pressure, equivalent to preload in the spring 46. When displacing metering slots 49, in respect to bore 48, area of metering orifice between the third control chamber 39 and the exhaust chamber 40 will be varied. Since constant pressure differential is automatically maintained between the exhaust chamber 40 and the third control chamber 39 and therefore across the metering slots 49, by the control spool 41, each specific area of metering slots 49 will correspond to a specific constant flow level from the third control chamber 39 to the exhaust chamber 40 and from the supply chamber 37 to the third control chamber 39, irrespective of the magnitude of the pressure in the supply chamber 37. Therefore, each specific position of stem 47, within the zone of metering slots 49, will correspond to a specific flow level and therefore a specific pressure drop $\Delta Px$ through the fixed orifice 20, irrespective of the magnitude of the load pressure Pw. When referring to FIG. 1 it can be seen that $P_1-Pw=\Delta Py$, $P_1-P_2=\Delta P$, maintained constant by the throttling section 13*a* and $Pw-P_2=\Delta Px$. From the above equations,, when substituting and eliminating $P_1$ and $P_2$ a basic relationship of $\Delta Py=\Delta P-\Delta Px$ is obtained. Since $\Delta Px$ can be varied and maintained constant at any level by the signal modifying section 13*b*, so can $\Delta Py$, acting across variable orifice 14, be varied and maintained constant at any level. Therefore with any specific constant area of variable orifice 14, in response to control signal 51, pressure differential $\Delta Py$ can be varied from maximum to zero, each specific level of $\Delta Py$ being automatically controlled constant, irrespective of variation in the load pressure Pw. Therefore, for each specific area of variable orifice 14 the pressure differential, acting across orifice 14 and the flow through orifice 14 can be controlled from maximum to minimum by the signal modifying section 13*b*, each flow level automatically being controlled constant by the differential throttling control 13, irrespective of the variation in the load pressure Pw. From inspection of the basic equation $\Delta Py=\Delta P-\Delta Px$ it becomes apparent that with $\Delta Px=0$, $\Delta Py=\Delta P$ and that system will revert to the mode of operation of conventional load responsive system, with maximum constant $\Delta P$ of the differential throttling control 13. When $\Delta Px=\Delta P$, $\Delta Py$ becomes zero, outlet pressure from the differential throttling control 13 $P_1$ will be equal to load pressure Pw and the flow through variable orifice 14 will become zero. With $\Delta Px$ larger than $\Delta P$, pressure $P_1$ will become smaller than load pressure Pw and the load check 18*a* will seat.

In the load responsive system of FIG. 1 for each specific value of $\Delta Py$, maintained constant by the modifying section 13*b* through the throttling section 13*a* of the differential control 13, the area of variable orifice 14 can be varied, each area corresponding to a specific constant flow into the fluid motor 15, irrespective of the variation in the magnitude in the load pressure Pw. Conversely, for each specific area of the variable orifice 14 pressure differential $\Delta Py$, acting across orifice 14, can be varied by the signal modifying section 13*b*, through the throttling section 13*a* of the differential throttling control 13, each specific pressure differential $\Delta Py$ corresponding to a specific constant flow into the fluid motor 15, irrespective of the variation in the magnitude of the load pressure Pw. Therefore fluid flow into fluid motor 15 can be controlled either by variation in area of variable orifice 14, or by variation in pressure differential $\Delta Py$, each of those control methods displaying identical control characteristics and controlling flow, which is independent of the magnitude of the load pressure. Action of one control can be superimposed on the action of the other, providing a unique system, in which, for example, a command signal from the operator, through the use of variable orifice 14 can be corrected by signal 51 from a computing device, acting through the signal modifying section 13*b*.

Referring now to FIG. 2, the signal modifying section 13*b*, is identical to the signal modifying section 13*b* of FIG. 1 and performs in an identical way, by modifying a control signal transmitted to the throttling section 13*a*. The throttling section 13*a* of FIG. 2 is identical to the throttling section 13*a* of FIG. 1. However, the signal modifying section 13*b* of FIG. 2 modifies the control signal from outlet chamber 23 and therefore from upstream of the variable orifice 14, instead of modifying the control signal of load pressure Pw, as shown in the system of FIG. 1. In FIG. 2 the load pressure signal Pw is transmitted directly from fluid motor 15 to the second control chamber 25 of the throttling section 13*a*. Then, as can be seen in FIG. 2, $P_1-Pw=\Delta Py$, $P_1-P_2=\Delta Px$ and $P_2-Pw=\Delta P$, which, in a manner as previously described, is the basic system differential and is maintained constant by the throttling section 13*a* of the differential throttling control 13. From the above equations, when substituting and eliminating $P_1$ and $P_2$, the basic relationship of $\Delta Py=\Delta P+\Delta Px$ can be obtained. Since $\Delta Px$ can be varied and maintained constant at any level, so can $\Delta Py$, acting across variable orifice 14 be varied and maintained constant at any level. From inspection of the basic equation $\Delta Py=\Delta P+\Delta Px$ it becomes apparent that with $\Delta Px=0$, $\Delta Py=\Delta P$ and that the system will revert to the mode of operation of conventional load responsive system, with minimum constant $\Delta P$ equal to pressure differential of the throttling section 13*a*. Any value of $\Delta Px$, other than zero, will increase the pressure differential $\Delta Py$, acting across variable orifice 14 above the level of constant pressure differential $\Delta P$ of the throttling section 13*a*. Therefore, the load responsive control arrangement of FIG. 1 will control $\Delta Py$ in a range between $\Delta P$ and zero, while the load responsive arrangement of FIG. 2 will control $\Delta Py$ in a range above the level of constant pressure differential ΔP of the throttling section 13*a*.

Referring now to FIG. 3, the load responsive system is identical to the load responsive system of FIG. 1 with the exception of the flow control valve section 52*b* and the metering valve section 52*c*, which, when combined together are equivalent to the signal modifying section 13*b* of FIG. 1 and perform in a very similar way. The throttling section 52*a* of FIG. 3 is identical to the throttling section 13*a* of FIG. 1. It is apparent that the differential throttling control 52 of FIG. 3 performs in an identical way as the differential throttling control 13 of FIG. 1. The flow control valve section 52*b* of the differential throttling control 52 in the housing 21, is provided with bore 62, guiding the metering pin 64, which is subjected to pressure in the third pressure chamber 61, which is connected by port 60 with the second control chamber 25, to the reservoir pressure in the second exhaust chamber 63 and to the biasing force of the spring 67. Subjected to pressure in the third pressure chamber 61 the metering pin 64 will move from left to right, each specific pressure level corresponding to a specific position of metering pin 64, in respect to the housing 21 and also corresponding to the specific biasing force of spring 67. Each specific position of metering pin 64, in respect to the housing 21, will correspond to a specific flow area of metering slot 65, interconnecting the third pressure chamber 61 with the second exhaust chamber 63. The shape of metering slot 65 and the characteristics of the biasing spring 67 are so selected, that variation in effective orifice area of metering slot 65, in respect to pressure in the third pressure chamber 61, will provide a relatively constant flow from the third pressure chamber 61 to the second exhaust chamber 63. To obtain special control characteristics of the load responsive control the shape of the metering slot 65 may be so selected, that any desired relationship between the flow from the third pressure chamber 61 and its pressure level can be obtained. Assume that the flow control valve section 52*b* provides a constant flow from the third pressure chamber 61 and therefore from the second control chamber 25, irrespective of its pressure level. Then, in a well known manner, the flow control valve section 52*b* could be substituted by a conventional flow control valve, well known in the art. Constant flow to the third pressure chamber 61 is supplied from fluid motor 15 through the metering valve section 52*c*, second control chamber 25 and port 60. The metering valve section 52*c*, upstream of the flow control valve section 52*b* is provided with a bore 55, guiding the stem 47, provided with metering slots 58. Displacement of metering slots 58 past bore 55 creates an orifice, the effective area of which can be varied by positioning of stem 47 by the actuator 50, in response to external control signal 51. With stem 47 engaging bores 55 the flow area of the metering valve section 52*c* becomes zero. Therefore, in response to external control signal 51, the effective flow area through the metering valve section 52*c* can be varied from zero to a selected maximum value. Since the flow through the metering valve section 52*c* is maintained constant by the flow control valve 52*b*, each specific area of flow through the metering valve section 52*c*, in a well known manner, will correspond to a specific constant pressure drop ΔPx, irrespective of the variation in the load pressure Pw. Therefore the load pressure signal can be modified in the second control chamber 25 of the throttling section 52*a*, each value of pressure drop ΔPx, maintained constant by the flow control valve section 52*b*, corresponds to a specific value of pressure differential ΔPy, following the basic relationship of $\Delta Py = \Delta P - \Delta Px$. Therefore the control characteristics of the load responsive control of FIG. 3 will be identical to those described, when referring to FIG. 1, the pressure differential ΔPy being varied and maintained constant, at each specific level, by the control action of the flow control valve section 52*b* and the metering valve section 52*c*, in response to external control signal 51, between maximum value equal to ΔP and zero.

In a manner as previously described the shape of metering slot 65 and the biasing force characteristics of spring 67 can be so selected, that any desired relationship between pressure in the third pressure chamber 61 and the fluid flow through the metering valve section 52*c* can be obtained. Assume that in response to a specific external control signal 51 a specific flow area was created through the metering valve section 52*c*. Then controlled increase in flow through the metering valve section 52*c*, with increase in load pressure, will proportionally increase the pressure differential ΔPx and therefore proportionally decrease the pressure differential ΔPy, effectively decreasing the gain of the load responsive control with increase in the load pressure. Conversely, a controlled decrease of flow through the specific orifice area of the metering valve section 52*c*, with increase in the load pressure will proportionally decrease the pressure differential ΔPx and therefore proportionally increase the pressure differential ΔPy, effectively increasing the gain of the load responsive control, with increase in the load pressure. As is well known in the art, the stability margin of most fluid flow and pressure controllers decreases with increase in system pressure. Therefore the capability of adjusting the system gain, in respect to system pressure, is of primary important. With the flow control valve section 52*b* the rate of change of pressure differential ΔPy, in respect to load pressure, does not have to be constant and can be varied in any desired way.

Referring now to FIG. 4, the load responsive system is similar to that of FIG. 1. The throttling control 68, of the differential throttling control of FIG. 4, is identical to differential throttling section 13*a* of FIG. 1. However, the differential valve 71 is different from the signal modifying section 13*b* of FIG. 1, although it performs the same function and provides identical performance. The differential valve, generally designated as 71, contains the solenoid, generally designed as 74, which consists of coil 72, secured in the housing 21 and the armature 73, slidably guided in the coil 72. The armature 73 is provided with conical surface 75, which, in cooperation with sealing edge 76, regulates the pressure differential ΔPx between inlet port 77 and port 69. A comparatively weak unnumbered spring can be interposed between the armature 73 and the housing 21, to permit a back flow under deenergized condition of the coil 72 from port 69 to inlet port 77. This feature may be of importance, when using a shuttle valve logic system instead of a check valve system, for transmittal of control signals. The sealed connector 81, in the housing 21, well known in the art, connects the coil 72 with external terminals, to which the external signal 51 can be applied. A solenoid is an electro-mechanical device, using the principle of electro-magnetics, to produce output force from electrical input signals. The force developed on the solenoid armature 73 is a function of the input current. As the current is applied to the coil 72, each specific current level will correspond to a specific force level, transmitted to the armature. Therefore, the contact force between the conical surface 75 of the armature 73 and sealing edge 76 of housing 21 will vary and be controlled by the input current. This arrangement will then be equivalent to a type of differential pressure throttling valve, varying automatically the pressure differential ΔPx between inlet port 77 and the second control chamber 25, in proportion to the force developed in the armature 73, in respect to the area enclosed by the sealing edge 76 and therefore proportional to the external signal 51, of the input current supplied to the solenoid 74. The pressure forces acting on the armature 73, within the housing 21, are completely balanced with the exception of the pressure force due to the pressure differential ΔPx acting on the enclosed area of sealing edge 76. This force is partially balanced by the reaction force, developed on the cross-sectional area of the reaction pin 80, guided in a bore 79, which is connected through venting passage 78 with inlet port 77. The cross-sectional area of the reaction pin 80 must always be smaller than the area enclosed by sealing edge 76, so that a positive force, due to the pressure differential ΔPx, opposes the force developed by the solenoid 74. The reaction pin 80 permits use of a larger inlet port 77, while also permitting a very significant reduction in the solenoid 74, also permitting the solenoid 74 to work in the higher range of ΔPx. The second control chamber 25 may be connected by the control valve section **52*b*, described in detail when referring to FIG. 3**, with the system reservoir.

Referring now to FIG. 5, the load responsive system is identical to that as shown in FIG. 1 with identical differential throttling controls being used, but the variable orifice 14 of FIG. 1 was substituted in FIG. 5 by a load responsive four way type direction control valve, generally designated as 83. The performance of the control embodiments of FIGS. 1 and 5 is identical, the only difference being that construction of the variable orifice. The differential throttling control and specifically the second load chamber 25 are connected through orifice 20 and passage 103 with the load sensing ports 101 and 102 of four way valve 83. With the valve spool 91 in its neutral position, as shown in FIG. 5, load pressure sensing ports 101 and 102 are blocked by the land 93 and therefore effectively isolated from load pressure, existing in load chamber 86 or 87. Under those conditions, in a well known manner, the differential throttling control 13, automatically maintains minimum pressure in the supply chamber 85 and equal to ΔP of the throttling section **13*a*. Displacement of the valve spool 91 from its neutral position in either direction, first connects with signal slot 99 or 100 load chamber 86 or 87 with load pressure sensing port 101 or 102, while load chambers 86 and 87 are still isolated by the valve spool 91 from the supply chamber 85 and exhaust chambers 88 and 89. Then the load pressure signal is transmitted through load pressure sensing port 101 or 102, passage 103 and orifice 20 to the second control chamber 25, permitting the differential throttling control 13 to react, before metering orifice is open to the load chamber 86 or 87. Further displacement of valve spool 91, in either direction, will create, in a well known manner, through metering slot 96 or 97 a metering orifice between one of the load chambers and the supply chamber 85, while connecting the other load chamber, through metering slot 95 or 98 with the exhaust chambers, in turn connected to system reservoir. The metering orifice can be varied by displacement of valve spool 91, each position corresponding to a specific flow level into one of the load chambers, irrespective of the magnitude of the load controlled by four way valve assembly 83. Upon this control, in a manner as previously described when referring to FIG. 1, can be superimposed the control action of the signal modifying section 13*b*. With valve spool 91 displaced to any specific position, corresponding to any specific area of metering orifice, the flow into load chambers can be proportionally controlled by the differential throttling control 13 with its signal modifying section 13*b*, each value of pressure differential ΔPy being automatically maintained at a constant level by the throttling section 13*a* and corresponding to a specific flow level into load chambers, irrespective of the magnitude of the load controlled by the four way valve assembly 83**.

Referring now to FIG. 6, the stem 47 of the actuator 50 of FIGS. 1 to 5 is biased by spring 104 towards position of zero orifice and is directly operated by a lever 105, which provides the external signal in the form of manual input.

Referring now to FIG. 7, the stem 47 of actuator 50 of FIGS. 1 to 5 is biased by spring 106 towards position of zero orifice and is directly operated by a piston 107. Fluid pressure is supplied, in a well known manner, to the piston 107 from a pressure generator 108, operated by a lever 109. Therefore the arrangement of FIG. 7 provides the external signal 51 in the form of a fluid pressure signal.

Referring now to FIG. 8, the stem 47 of the actuator 50 of FIGS. 1 to 5 is biased by a spring 110 towards position of zero orifice and is directly operated, in a well known manner, by a solenoid 111, connected by a line to an input current control 112, operated by a lever 113 and supplied from an electrical power source 114. Therefore the arrangement of FIG. 8 supplies the external signal 51 in the form of an electric current, proportional to displacement of lever 113.

Referring now to FIG. 9, the stem 47 of the differential control 115 is biased by a spring 116 towards a position, where it isolates the third control chamber 39 from the exhaust chamber 40. The stem 47 is completely pressure balanced, can be made to operate through a very small stroke and controls such low flows, at such low pressures, that the influence of flow forces is negligible. In any event, if the area of metering slots 49 is so selected, that it provides a linear function in respect to displacement of the stem 47 and a constant pressure is maintained in front of the orifice, the flow force will also be linear and will add to the spring force, changing slightly the combined rate of the spring. The stem 47 is directly coupled to a solenoid 117. A solenoid is an electro-mechanical device using the principle of electro-magnetics, to produce output forces from electrical input signal. The position of solenoid armature, when biased by a spring, is a function of the input current. As the current is applied to the coil, the resulting magnetic forces generated move the armature from its deenergized position to its energized position. When biased by a spring, for each specific current level there is a corresponding particular position, which the solenoid will attain. As the current is varied from zero to maximum rating, the armature will move one way from a fully retracted to a fully extended position in a predictable fashion, depending on the specific level of current at any one instant. Since the forces, developed by solenoid 117 are very small, so is the input current, which is controlled by a logic circuit or a microprocessor 119. The micro-processor 119 will then, in response to different types of transducers either directly control the system load, in respect to speed, force and position, or can superimpose its action upon the control function of an operator, to perform required work in the minimum time, with a minimum amount of energy, within the maximum capability of the structure of the machine and within the envelope of its horsepower.

Referring now to FIG. 10, the control signal from the logic circuit, or the micro-processor 123, in a similar way as described in FIG. 9, is directly transmitted through the amplifier 127 to the differential pressure control 71, where, through a solenoid and throttling valve combination, in a manner as previously described, when referring to FIG. 4, regulates the pressure differential in response to input current.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A load responsive valve assembly comprising a housing having an inlet chamber connected to a pump, a supply chamber connected to a fluid motor, and exhaust means, control orifice means interposed between said supply chamber and said fluid motor, and fluid throttling means interposed between said inlet chamber and said supply chamber, first control means operable through said fluid throttling means to maintain a pressure differential across said control orifice means at a controlled constant level and second control means operable through said first control means to vary the level of said constant pressure differential proportionally in response to a control signal.

2. A valve assembly comprising a housing having an inlet chamber connected to a pump, a supply chamber connected to a fluid motor, and exhaust means, control orifice means interposed between said supply chamber and said fluid motor, first valve means having fluid throttling means operable to throttle fluid flow from said inlet chamber to said supply chamber to maintain a constant pressure differential at a preselected constant level across said first valve means and to maintain a constant pressure differential across said control orifice means, and second valve means having means operable through said fluid throttling means of said first valve means to vary the level of said constant pressure differential controlled across said control orifice means while said pressure differential across said first valve means remains constant at said constant predetermined level.

3. A valve assembly comprising a housing having an inlet chamber connected to a pump, a supply chamber connected to a fluid motor, and exhaust means, control orifice means interposed between said supply chamber and said fluid motor, first valve means having control means and fluid throttling means operable to throttle fluid flow from said inlet chamber to said supply chamber to maintain a constant pressure differential at a preselected constant level across said control means of said first valve means and to maintain a constant pressure differential across said control orifice means, and second valve means having means operable through said fluid throttling means of said first valve means to vary the level of said constant pressure differential across said control orifice means while said pressure differential across said control means of said first valve means remains constant at said constant predetermined level.

4. A valve assembly as set forth in claim 3 wherein said control orifice means has variable area orifice means.

5. A valve assembly as set forth in claim 3 wherein said second valve means has means responsive to an external control signal.

6. A valve assembly comprising a housing having an inlet chamber connected to a pump, a supply chamber connected to a fluid motor subjected to load pressure, and exhaust means, control orifice means interposed between said supply chamber and said fluid motor, and fluid throttling means interposed between said inlet chamber and said supply chamber, control signal transmitting means having means to transmit a first pressure signal from said supply chamber and means to transmit a second pressure signal from said load pressure, control means of said fluid throttling means having valve means communicable with said first and said second pressure signals and operable to throttle fluid flow from said inlet chamber to said supply chamber to maintain a relatively constant pressure differential at a constant predetermined level across said valve means and to maintain a constant pressure differential across said control orifice means, and pressure signal modifying means of said control signal transmitting means operable to vary the level of said constant pressure differential controlled across said control orifice means while said pressure differential acting across said valve means remains constant at said constant predetermined level.

7. A valve assembly as set forth in claim 6 wherein said control orifice means has variable area orifice means.

8. A valve assembly comprising a housing having an inlet chamber connected to a pump, a supply chamber connected to a fluid motor, a control chamber, and exhaust means, control orifice means interposed between said supply chamber and said fluid motor, a fluid throttling means between said inlet chamber and said supply chamber operable to throttle fluid flow from said inlet chamber to said supply chamber to maintain a constant pressure differential at a constant predetermined level between said supply chamber and said control chamber and to maintain a constant pressure differential across said control orifice means, pressure signal transmitting means operable to transmit a control pressure signal from upstream of said control orifice means to said control chamber, and modifying means of said control pressure signal operable through said fluid throttling means to vary the level of said constant pressure differential controlled across said control orifice means while said pressure differential between said supply chamber and said control chamber remains constant at said constant predetermined level.

9. A valve assembly as set forth in claim 8 wherein said modifying means of said control signal has means to vary the level of said constant pressure differential across said control orifice means below the level of said pressure differential between said supply chamber and said control chamber maintained constant at said constant predetermined level.

10. A valve assembly as set forth in claim 8 wherein said modifying means of said control signal includes constant pressure reducing means, orifice means upstream of said constant pressure reducing means, and flow orifice means down stream of said constant pressure reducing means.

11. A valve assembly as set forth in claim 8 wherein said modifying means of said control signal includes flow orifice means and a pressure responsive flow control means down stream of said flow orifice means.

12. A valve assembly as set forth in claim 8 wherein said modifying means of said control signal includes fluid throttling means and orifice means down stream of fluid throttling means communicable with said exhaust means.

13. A valve assembly as set forth in claim 8 wherein said modifying means of said control signal has means responsive to an external control signal.

14. A valve assembly comprising a housing having an inlet chamber connected to a pump, a supply chamber connected to a fluid motor, a first control chamber, a second control chamber, and exhaust means, control orifice means interposed between said supply chamber and said fluid motor, first pressure signal transmitting means operable to transmit a first pressure signal from said supply chamber to said first control chamber, second signal transmitting means operable to transmit a second control pressure signal from downstream of said control orifice means to said second control chamber, fluid throttling means between said inlet chamber and said supply chamber operable to throttle fluid flow from said inlet chamber to said supply chamber having means responsive to said first and second control pressure signals to maintain a constant pressure differential at a constant predetermined level between said first and said second control chambers and to maintain a constant pressure differential across said control orifice means, and modifying means of said first control pressure signal operable through said fluid throttling means to vary the level of said constant pressure differential controlled across said control orifice means while said pressure differential between said first and second control chambers remains constant at said constant predetermined value.

15. A valve assembly as set forth in claim 14 wherein said control orifice means has variable area orifice means.

16. A valve assembly as set forth in claim 14 wherein said modifying means of said first control pressure signal has means to vary the level of said constant pressure differential across said control orifice means above the level of said pressure differential between said first and second control chambers maintained constant at said constant predetermined level.

17. A valve assembly as set forth in claim 14 wherein said modifying means of said first control pressure signal includes constant pressure reducing means, orifice means upstream of said constant pressure reducing means, and flow orifice means down stream of said constant pressure reducing means.

18. A valve assembly as set forth in claim 14 wherein said modifying means of said first control pressure signal includes flow orifice means and a pressure responsive flow control means down stream of said flow orifice means.

19. A valve assembly as set forth in claim 14 wherein said modifying means of said first control pressure signal includes fluid throttling means and orifice means down stream of said fluid throttling means communicable with said exhaust means.

20. A valve assembly as set forth in claim 14 wherein said modifying means of said first control pressure signal has means responsive to an external control signal.

21. A valve assembly comprising a housing having a fluid inlet chamber, a fluid supply chamber, at least one load chamber, and exhaust means, first valve means for selectively interconnecting said load chamber with said supply chamber and said exhaust means, said first valve means having a variable orifice means between said supply chamber and said load chamber, second valve means having fluid throttling means operable to throttle fluid flow from said inlet chamber to said supply chamber to maintain a constant pressure differential at a preselected constant level across said second valve means and to maintain a constant pressure differential across said variable orifice means, and third valve means having means operable through said fluid throttling means of said second valve means to vary the level of said constant pressure differential controlled across said variable orifice means while said pressure differential across said second valve means remains constant at said constant predetermined level.

22. A valve assembly comprising a housing having a fluid inlet chamber, a fluid supply chamber, at least one load chamber, and exhaust means, first valve means for selectively interconnecting said load chamber with said supply chamber and said exhaust means, variable orifice means between said supply chamber and said load chamber operable by said first valve means, load pressure sensing means selectively communicable with said load chamber by said first valve means, and fluid throttling means interposed between said inlet chamber and said supply chamber, control signal transmitting means having means to transmit a first pressure signal from said supply chamber and means to transmit a second pressure signal from said load pressure sensing means, control means of said fluid throttling means having valve means communicable with said first and said second pressure signals and operable to throttle fluid flow from said inlet chamber to said supply chamber to maintain a relatively constant pressure differential at a constant predetermined level across said valve means and to maintain a constant pressure differential across said variable orifice means, and pressure signal modifying means of said control signal transmitting means operable to vary the level of said constant pressure differential controlled across said variable orifice means while said pressure differential acting across said valve means remains constant at said constant predetermined level.

23. A valve assembly as set forth in claim 22 wherein said first valve means has a neutral position in which it blocks said load pressure sensing means, said first valve means when displaced from said neutral position first connecting said load pressure sensing means with said load chamber before connecting said supply chamber with said load chamber.

24. A valve assembly as set forth in claim 22 wherein said pressure signal modifying means has means operable to vary the level of said constant pressure differential controlled across said variable orifice means below the level of said pressure differential acting across said valve means.

25. A valve assembly as set forth in claim 22 wherein said pressure signal modifying means includes constant pressure reducing means, orifice means upstream of said constant pressure reducing means and flow orifice means down stream of said constant pressure reducing means.

26. A valve assembly as set forth in claim 25 wherein said orifice means upstream of said constant pressure reducing means has orifice area adjusting means.

27. A valve assembly as set forth in claim 22 wherein said pressure signal modifying means includes flow orifice means and a pressure responsive flow control means down stream of said flow orifice means.

28. A valve assembly as set forth in claim 27 wherein said flow orifice means has variable area orifice means.

29. A valve assembly as set forth in claim 22 wherein said pressure signal modifying means includes fluid throttling means and orifice means down stream of said fluid throttling means communicable with said exhaust means.

30. A valve assembly as set forth in claim 22 wherein said pressure signal modifying means has means operable to vary the level of said constant pressure differential controlled across said variable orifice means above the level of said pressure differential acting across said valve means.

31. A valve assembly as set forth in claim 22 wherein said pressure signal modifying means has means responsive to an external control signal.

32. A valve assembly as set forth in claim 31 wherein said means responsive to an external control signal includes mechanical actuating means.

33. A valve assembly as set forth in claim 31 wherein said means responsive to an external control signal includes fluid pressure actuating means.

34. A valve assembly as set forth in claim 31 wherein said means responsive to an external control signal includes electro-hydraulic actuating means.

35. A valve assembly as set forth in claim 31 wherein said means responsive to an external control signal includes electro-mechanical actuating means.

* * * * *